United States Patent [19]

Martin

[11] Patent Number: 5,065,544

[45] Date of Patent: Nov. 19, 1991

[54] WINDOW ASSEMBLY

[75] Inventor: Norman D. Martin, San Dimas, Calif.

[73] Assignees: Thomas B. Nuckolls; Stanley D. Daubenbis, both of Covina, Calif. ; part interest to each

[21] Appl. No.: 595,029

[22] Filed: Oct. 10, 1990

[51] Int. Cl.[5] ..... E05D 15/22

[52] U.S. Cl. ..... 49/177; 49/453

[58] Field of Search ..... 49/177, 161, 162, 178, 49/179, 180, 169, 404, 453

[56] References Cited

U.S. PATENT DOCUMENTS

| | | | |
|---|---|---|---|
| 1,659,924 | 2/1928 | Scarlato | 49/162 |
| 2,121,805 | 6/1938 | Leary | 49/162 |
| 3,099,866 | 8/1963 | Matranga | 49/162 |
| 3,226,779 | 1/1966 | Rust | 49/453 X |
| 3,805,450 | 4/1974 | Forcina | 49/404 X |
| 4,888,915 | 12/1989 | Goldenberg | 49/177 X |

*Primary Examiner*—Philip C. Kannan

*Attorney, Agent, or Firm*—Boniard I. Brown

[57] ABSTRACT

A window assembly including two horizontally slidable window units normally occupying separate portions of a window opening, which window units are selectively movable across the opening to provide a ventilation to an interior space. Each window unit comprises a four-sided rectangular frame and a windowpane haivng a hinged connection along a side edge of the frame. The windowpane can be swung out from the frame to a position normal to the frame, whereby the outer surface of the windowpane can be mannually cleaned from within the building space.

1 Claim, 2 Drawing Sheets

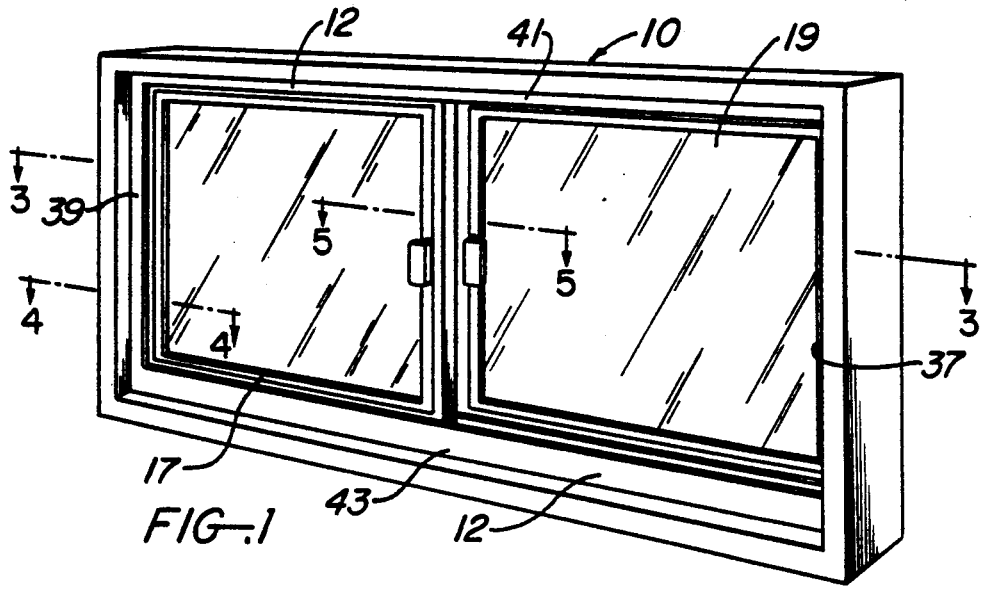
FIG-.1
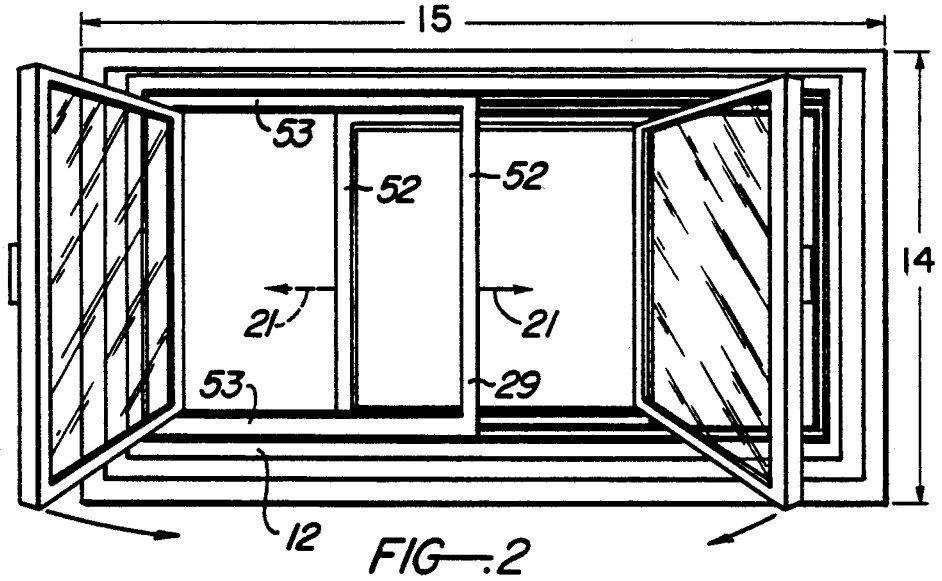
FIG-.2
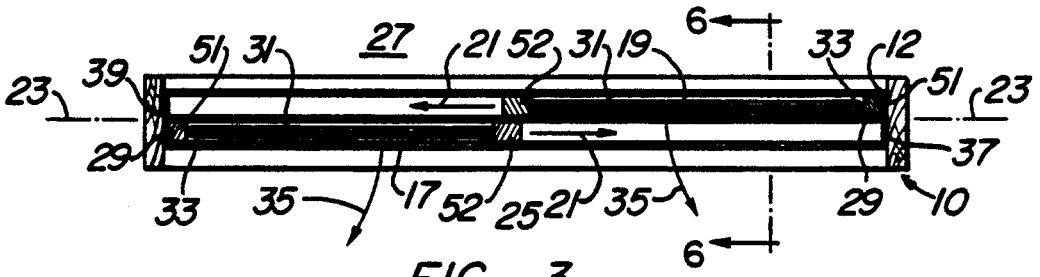
FIG-.3

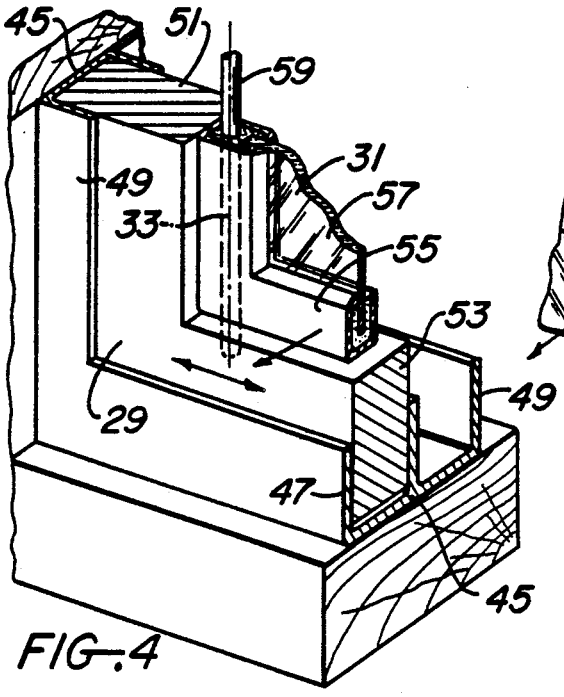
FIG-.4
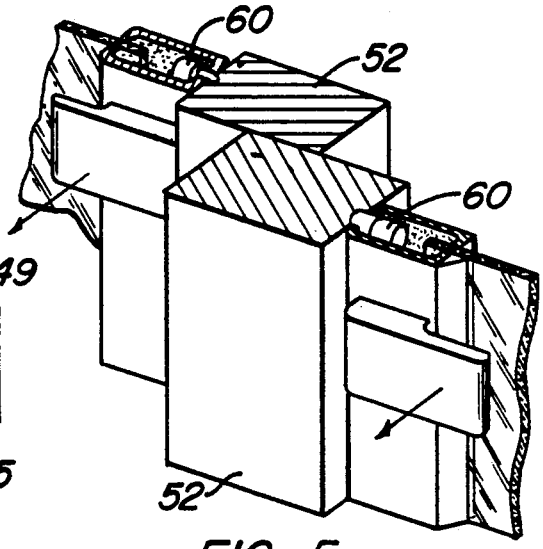
FIG-.5
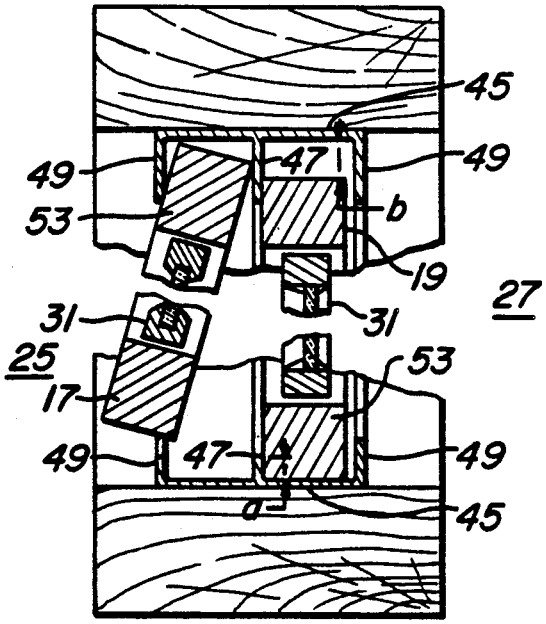
FIG-.6
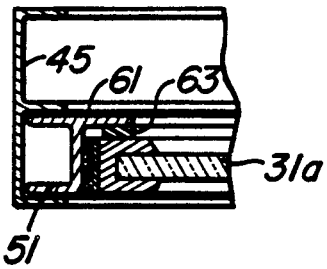
FIG-.7
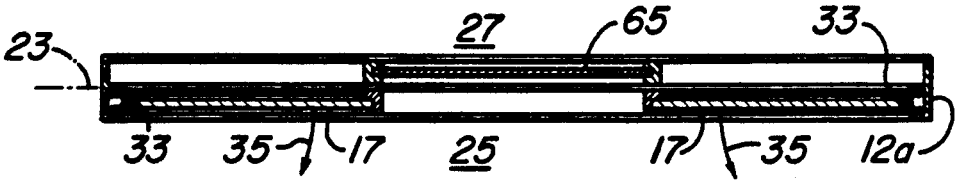
FIG-.8

WINDOW ASSEMBLY

BACKGROUND AND SUMMARY OF THE INVENTION

The present invention relates to a window assembly comprising two window units normally arranged so that one window unit closes one part of the window opening and the other window unit closes another part of the window opening. At least one of the window units is slidable horizontally to provide a ventilation opening through the window assembly.

A major feature of the invention is the provision of such window unit construction that a person can clean both faces of the windowpane without having to stand outside or lean precariously out through the window opening. Each window unit comprises a rectangular frame and a windowpane swingably mounted within the frame for movement from a normal position extending within the plane of the rectangular frame to a "wash" position extending into the building interior at approximately ninety degrees to the plane of the rectangular frame. In the wash position, the exterior surface of the windowpane is located entirely within the building where it may be readily cleaned by a person standing therein. In order to clean the interior surface of the windowpane, the windowpane is returned to its normal position and extends within the plane of the associated rectangular frame. During normal opening and closing motions of the window, the swingable pane stays within the plane of the rectangular frame. The window is opened or closed by sliding the rectangular frame horizontally transversely across the window opening.

U.S. Pat. Nos. 1,614,564 to C. Lynch, 2,349,543 to Escher, et al., and 3,464,157 to R. Rodriguez show window assemblies wherein a windowpane is swingably mounted within a slidable frame or slide structure. In the Lynch and Escher, et al., arrangements, a windowpane is pivotably mounted on a horizontal axis midway between the upper and lower edges of the pane. This arrangement is somewhat disadvantageous in that it is difficult to seal the various joints between the pivotable pane and the surrounding frame. According to the present invention, the windowpane is swingably connected to the surrounding frame along one side edge of the windowpane. The joint between the windowpane and the frame can be effectively sealed with a relatively uncomplicated seal structure. Also, the windowpane is disposed entirely within the room when it is in the wash position. With the arrangements of the Lynch and Escher, et al., patents, the windowpane extends transversely through the plane of the rectangular frame when it is in the wash position; the windowpane is located partly outside the building, thereby complicating the washing process.

The Rodriguez patent shows an arrangement wherein individual sash units are swingably connected to elongated runners which slide in fixed vertical tracks. This is disadvantageous in that the runners are interconnected solely by the hinged portion of the swingable sash. Thus, the runners would tend to bind or become cocked relative to the tracks because of the lack of rigidity in the connecting mechanism between the two runners. In the arrangement of the present invention, each windowpane is swingably mounted within a four-sided rectangular frame. The frame is a relatively rigid structure that can slide back and forth within a fixed track structure with minimum tendency to bind or become cocked.

In a preferred form of the invention, two horizontally slidable window units collectively close the window opening. Each window unit comprises a four-sided rectangular frame, and a windowpane having a hinged connection along one side edge of the frame, whereby the pane can be swung between a normal position within the plane of the frame and a "wash" position extending from the frame into the building interior. The slidable window units are so arranged that when the units are in their closed positions, both window panes can be swung to the wash positions. It is not necessary to manipulate either frame or move either window unit to a partially-opened position. With the window units locked together in the closed position, the two rectangular frames are stabilized in a relatively rigid condition, thereby forming a rigid base structure for the swingable panes. The washing process can be carried out without any rattling or movement of the rectangular frames.

In the preferred form of the invention, both window units are of the same size and essentially the same construction, thereby reducing manufacturing costs. Also, the window units are designed to be removable from the stationary tracks without alteration or partial dismantling of the window units. Each window unit occupies only slightly more than one-half the width dimension of the window opening so that, when one of the window units is slidably moved to an open condition, a relatively large ventilation opening is provided. The window assembly thus provides an "easy wash" feature, along with these additional advantageous features.

BRIEF DESCRIPTION OF THE DRAWINGS

FIG. 1 is a perspective view of a window assembly of the present invention, taken from a building interior side of the window;

FIG. 2 is a front interior view of the FIG. 1 window assembly with the window panes swung away from the supporting rectangular frames;

FIG. 3 is a sectional view taken on line 3—3 in FIG. 1;

FIG. 4 is a fragmentary perspective view of structural details of the FIG. 1 window assembly, generally taken on line 4—4 in FIG. 1;

FIG. 5 is a fragmentary perspective view of the structural detail of the FIG. 1 window assembly, generally taken on line 5—5 in FIG. 1;

FIG. 6 is a fragmentary sectional view taken on line 6—6 in FIG. 3, showing one of the window units during removal of the window unit from the stationary window frame;

FIG. 7 is a fragmentary sectional view taken through a structural detail that may be used as an alternative to the structure shown in FIG. 4; and FIG. 8 is a sectional view similar to the view of FIG. 3, illustrating another form of the invention.

DESCRIPTION OF A PREFERRED EMBODIMENT OF THE INVENTION

Referring to the drawings, a window assembly 10 comprises a hollow stationary frame 12 having a vertical dimension 14 (FIG. 2) and a horizontal dimension 15. Two substantially identical window units 17 and 19 are arranged within frame 12 for horizontal sliding movement, as indicated by arrows 21 in FIG. 3. FIG. 3 shows the window units in their closed positions, i.e., positions completely closing the space circumscribed by frame 12. Window unit 17 is herein sometimes designated as the interior window unit because it is offset from the midplane 23 of stationary frame 12 in the direction of interior room space 25. Window unit 19 may be considered the exterior window unit because it is offset from plane 23 toward the exterior (outside) space 27.

Each window unit 17 or 19 comprises a four-sided rectangular frame 29 slidable in upper and lower tracks in stationary frame 12, as indicated by arrows 21 in FIG. 3. Disposed within each frame 29 is a swingable windowpane means 31, as shown in FIG. 3. Each pane means 31 is pivotable (swingable) about a vertical swing axis 33, as indicated by arcuate arrows 35. With both window units 17 and 19 in closed positions, the two windowpane means 31 can be swung about their respective pivot axes 33 to positions extending into room space 25 at right angles to plane 23 of stationary frame 12. The exterior surfaces of both window panes can thus be readily cleaned or washed by a person standing in the room. During normal window operation both window panes 31 are swung outwardly into their respective frames 29.

Stationary frame 12 may be of generally conventional constructuion. As shown, the stationary frame comprises two vertical side members 37 and 39, and two horizontal members 41 and 43. Each of the four members has a multi-flanged cross-section, as shown in FIG. 4, which includes a web wall 45, a center flange 47, and two side (outboard) flanges 49. The upper and lower frame members 41 and 43 form tracks for sliding guidance of slidable frames 29. Center flange 47 on each member 41, 43 cooperates with side flanges 49 to form two offset tracks for frames 29, whereby each frame 29 can move back and forth within a separate set of tracks.

Portions of the outer (exterior) tracks can be used to support a window screen (not shown). Each rectangular frame 29 may be formed in a variety of different cross-sectional configurations. As shown, each frame 29 comprises two vertical side rails 51 and 52, and two horizontal connector rail members 53, each being of rectangular cross-section.

Each windowpane means 31 comprises a channel cross-sectioned rim structure 55 and a transparent glass or plastic pane 57. Along one side edge of the windowpane means there is provided a vertical pivot rod 59, the upper and lower ends of which extend into sockets provided in frame rail members 53, whereby the rod forms a pivot or hinge means to enable the windowpane means 31 to swing away from the plane of frame 29, as indicated by arrows 35 in FIG. 3.

The other side edge of each windowpane means 31 has a suitable latch or lock mechanism 60 (FIG. 5) for normally retaining the windowpane means within the plane of the associated frame 29. Mechanism 60 may be hand-operated or key-operated from within the building or room space for security purposes. Also, another lock mechanism, not shown, may be provided between rails 52 of the two slidable frames 29 to normally retain the two window units 17 and 19 in their closed positions (FIG. 3).

As indicated in FIG. 3, when window units 17 and 19 are in their closed positions, both windowpane means 31 can be swung into the room space to their "wash" positions. With window units 17 and 19 locked together in their closed positions, the respective frames 29 form an immovable rigid base for the two swingable windowpane means 31. Each windowpane can be cleaned without any rattling or dislocation of the associated frames 29.

Each window unit 17 or 19 is preferably designed for complete removal from stationary frame 12, as shown generally in FIG. 6. Flanges 47 and interior flanges 49 on track members 41 and 43 have their edges spaced apart a slightly lesser distance than the vertical dimension of the associated window units, whereby the window units can individually be lifted and removed from the tracks into building interiors or room space 25. It is not necessary that a person go outside the building to remove the window units. A window removability feature is thus provided in connection with a window assembly having the easy-clean feature of the present invention.

In a preferred practice of the invention, both window units 17 and 19 are of the same size and construction, except for ancillary hardware needed to operate the window units or lock them together. In their closed positions of FIG. 3, the two window units have their side rails 52 overlapped, each window unit having a width dimension only slightly greater than one-half the spacing between stationary side members 37 and 39. When window unit 17 is fully opened, a relatively large ventilation space is provided between the left edge of unit 17 and stationary side member 39.

FIG. 7 illustrates one way to form a sealed joint between the windowpane means and the associated rectangular frame. The illustrated frame includes a side rail 51 having a flange 61 that carries an elastomeric sealing strip 63. Windowpane means 31*a* is hingedly connected to side rail 51, such that when the windowpane means is in the FIG. 7 position, its outer face seals against strip 63. All four members of frame 29 have the cross-section shown in FIG. 7, and each frame member has therein a sealing strip.

FIG. 8 illustrates a form of the invention which comprises a stationary central window unit 65 and two transversely slidable window units 17 normally located on either side of unit 65. Each window unit 17 may be considered to be an interior window unit because it is located on the interior or room side of a midplane 23 extending through the stationary window frame 12*a*. Each window unit 17 is slidable positioned in the same set of tracks for horizontal motion into the central space along the interior face of fixed window unit 65. Each window unit 17 has the same slide plane, so that only one of the two window units can be fully opened at any one time.

Each window unit 17 (FIG. 8) is constructed as shown generally in FIGS. 1 through 7, such that the exterior surfaces of the windowpane in either unit 17 can be swung into the interior or room space, as indicated by arrows 35 in FIG. 8. The exterior surface of the windowpane in central unit 65 can also be cleaned from a point inside the building.

Thus there has been shown and described a novel window assembly which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A window assembly comprising:

a stationary frame means including two upstanding side members, and upper and lower track means connecting said side members, each track means comprising an exterior track and an interior track offset from each other, an upstanding exterior window unit having upper and lower edge portions thereof extending into the exterior tracks, whereby said exterior window unit is slidably movable across the space between the upstanding side members, an upstanding interior window unit having upper and lower edge portions thereof extending into the interior tracks, whereby said interior unit is slidably movable across the space between the upstanding side members, each window unit comprising a rectangular frame having an upper rail, a lower rail, and two side rails, the two side rails defining the horizontal width dimension of the respective window unit, each window unit having a width dimension slightly greater than one-half the spacing between the stationary side members so that when the window units are in their fully closed positions two side rails thereof are in overlapping relation and the other two side rails are positioned against respective ones of the stationary side members, the said four rails of each movable window unit having flanges extending in a common plane within the profile plane of the window unit rectangular frame, resilient elastomeric sealing strips on the interior face of each flange to provide a substantially annular seal means, window pane means disposed within each rectangular frame and having a closed position wherein its exterior face engages the associated annular seal means to prevent passage of rain water through the joint between the window pane means and the associated frame, and hinge means having vertical axes and connecting each window pane means to one of said other two side rails of the associated rectangular frame, whereby each window pane means is swingable in a horizontal arc into a room interior space when the window units are in their fully closed positions.

* * * * *